United States Patent [19]

Poterala

[11] Patent Number: 4,859,860

[45] Date of Patent: Aug. 22, 1989

[54] FEATHER LIGHT WEB EDGE SENSOR

[76] Inventor: Robert J. Poterala, 140 Rocky Point, Greenville, S.C. 29615

[21] Appl. No.: 191,050

[22] Filed: May 6, 1988

[51] Int. Cl.[4] ..... G01N 21/86

[52] U.S. Cl. ..... 250/548; 250/561; 33/1 PT; 200/61.13

[58] Field of Search ..... 250/227, 229, 231 SE, 250/548, 560, 561; 33/1 PT, 551, 556; 200/61.13, 61.41

[56] References Cited

U.S. PATENT DOCUMENTS

| | | | |
|---|---|---|---|
| 2,448,639 | 9/1948 | Wachsman | 200/61.13 |
| 3,307,041 | 2/1967 | Kling | 250/229 |
| 3,569,642 | 3/1971 | Grover | 200/61.13 |
| 3,873,789 | 3/1975 | Ward | 200/61.13 |
| 4,077,579 | 3/1978 | Seleski et al. | 250/548 |
| 4,153,998 | 5/1979 | McMurtry | 33/556 |
| 4,303,189 | 12/1981 | Wiley et al. | 250/548 |
| 4,728,800 | 3/1988 | Surka | 250/548 |
| 4,809,188 | 2/1989 | Willits et al. | 250/548 |

*Primary Examiner*—David C. Nelms
*Assistant Examiner*—Stephone B. Allen
*Attorney, Agent, or Firm*—Cort Flint

[57] ABSTRACT

A web sensor for sensing the edge of a web in a feather like action is disclosed which includes a feeler (10) carried by rotary disk (12) which fits into a pair of housing sections (20, 24) and is coupled to the housing by means of weighted balls (32, 34, 36). The weighted balls are carried in a circumferential slot (42) with a clearance (44). The weighted balls extend into arcuate slots (38, 40) in the housing sections and dampen rapid oscillations in the pendular motion of feeler (10). Turning of rotary disk (12) interrupts a pair of energy beams which may be light (50A, 52A) or an air jet (124, 126). Depending upon which energy beam is interrupted, the web is moved accordingly until feeler (10) resumes its neutral position.

20 Claims, 4 Drawing Sheets

FEATHER LIGHT WEB EDGE SENSOR

BACKGROUND OF THE INVENTION

This invention relates to an improved web guiding system incorporating a feeler-type edge sensor utilizing fiber optic cables to transmit signals to allow the detection of a web position without distorting the web edge.

Feeler-type edge sensors have been used for many years in the processing of textile webs. The feeler-type sensor typically has a depending feeler finger which engages the web edge. This is good for positively and accurately sensing the position of the edge, particularly for woven fabric often having untucked selvages. However, the feeler-type sensors have required heavy mechanical input on the feeler to effect changing the electrical contacts. Additionally, these have required heavy springs or counter weights to prevent the feeler from "bouncing" during high speed movement. The heavy force required to counter these weights and springs usually distorts the web edges, making these sensors impractical for most applications. Examples of feeler-type sensors are shown in U.S. Pat. Nos. 2,448,639, 3,569,642, and 3,873,789.

As a result of the web distortion and bouncing problems associated with the use of feeler-type sensors, the industry has selected direct photo electric, beam breaking, or air jet resistance type sensors. These sensors do not physically contact the web edge, but rather attempt to accurately detect the edge location by interruption of an energy beam, i.e. light, air, etc. However, these non-contact senors have the disadvantage of easily becoming impaired in web edge detection. For example, photocell type light sensor become quited easily reduced in reliability with variations in the translucency of the web, and require frequent adjustment to web translucency. In the case of woven webs, there is often an untucked selvage. This means that loose yarns or threads may extend randomly from the edge. These untucked strands may easily falsely trigger the photocell as the edge of the web. Further, the sensors are subject to lint conditions which, in the case of a photocell, can cover the eye and impair dependability. When used to sense web edge location on coating machines, the photocell eye can easily become blocked by coating material falling on the eye.

Typical applications of web edge sensors are to guide textile webs on tenters and on coating machines. These applications often require that water be used for clean up. The prior contact and non-contact type web edge sensors are highly susceptible to water and moisture damage when used in this type environment.

Accordingly, an object of the invention is to provide a web edge sensor for guiding a web which accurately senses a web edge using light physical contact with the web and which also incorporates the positive switching aspects of energy beam interruption.

Another object of the invention is to provide a web edge sensor having a feather light feeler action for sensing the edge of a web without distorting the edge.

Another object of the invention is to provide a feeler-type web edge sensor in which bouncing is reduced during high speed web movement past the feeler.

Another object of the invention is to provide a web edge sensor having a feather light action which senses a web edge with reduced bouncing and can be used under hazardous environments such as chemicals and water.

SUMMARY OF THE INVENTION

The above objectives are accomplished according to the invention by providing a web sensor which combines the advantages of both the feeler and non-contact type web sensors while overcoming the disadvantages. A feeler finger is used to physically feel the web edge while an energy beam such as a light beam is used for switching. The feeler is mounted in a ball bearing pivot which allows sensing of any web edge, regardless of translucency or porosity. The feeler is carried by a switching disk. The arc of feeler swing moves the disk to interrupt the fiber optic light beam allowing the electrical circuit to detect position without imparting mechanical force to switch contacts. A sealed housing and design prevents lint accumulation. A floating multiple ball system stops bounce at high operational speeds and imparts only minimal feeler force against the web. Fiber optics allows this sensor to operate in hazardous environments such as would be encountered in chemical processing treatments.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
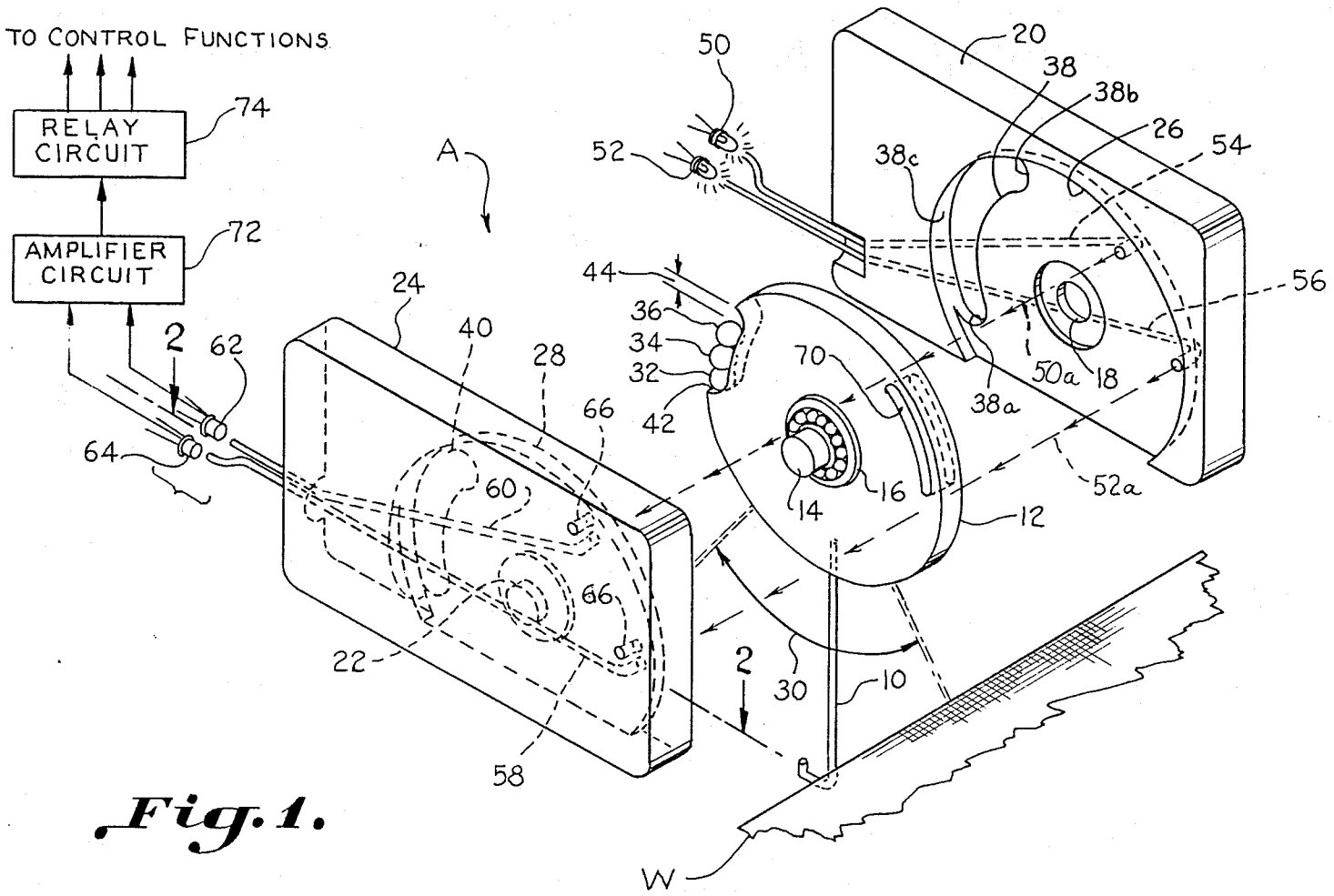
FIG. 1 is a perspective view with parts separated of a web edge sensor constructed in accordance with the present invention.
Figure 2:
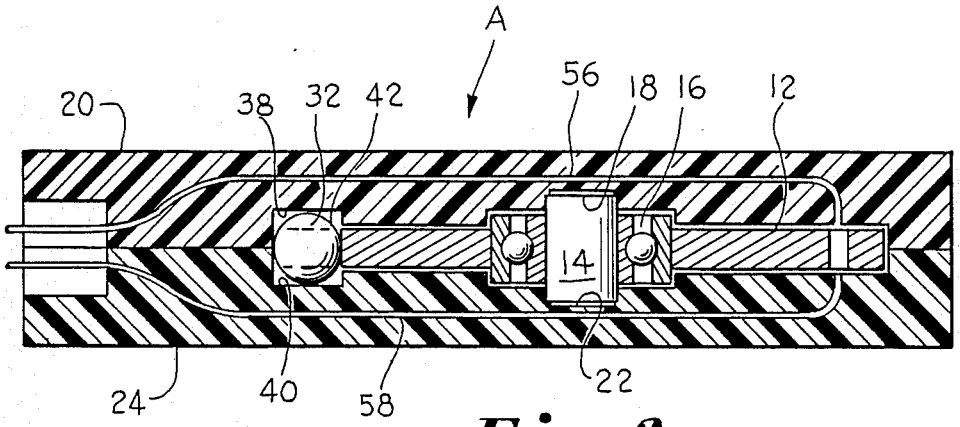
FIG. 2 is a sectional view taken along line 2—2 of FIG. 1.

Referring now in more detail to the drawings, a web edge sensor, designated generally as A, is illustrated. The sensor includes means for feeling the edge of the web in the form of a feeler 10 which may consist of a wire finger, as can best be seen in FIG. 1. Feeler 10 is carried in a pendular motion as suspended by a rotary means in the form of a trip disk 12. Trip disk 12 is carried by a shaft 14 which rotates in a bearing 16 affixed to trip disk 12. One end of shaft 14 is carried in a journal 18 formed in a first housing section 20. The opposing end of shaft 14 is carried in a journal 22 carried in a second housing section 24. Annular recess 26 formed in section 20 and corresponding annular recess 28 formed in section 24 receive trip disk 12 in a rotary manner.

Feeler 10 swings in an arc denoted by reference numeral 30 which is limited by roller balls 32, 34, and 36. The balls provide means for coupling the disk in the housing and limiting the pendular movement of feeler 10 by engaging the opposing ends 38*a*, 38*b* of an arcuate shaped slot 38 formed in housing section 20. Corresponding arcuate shaped slot 40 is engaged by the balls in housing section 24. It will be noted that housing sections 20 and 24 are the reverse image of each other. Balls 32, 34, and 36 are preferably constructed of steel to add a like counter-pressure to feeler 10 assuring that in its relaxed position, as can best be seen in FIG. 1, feeler 10 is at rest. The action of the balls will be described in reference to arcuate slot 38, it being understood that the balls in arcuate slot 40 act in the same way. While the sensor may be designed that only one slot is necessary, it is advantageous that slots 38 and 40 be utilized so that trip disk 12 fits more snuggly within annular recesses 26, 28, as will become more fully apparent in the description below.

The balls are free to travel in slot 38. The balls are retained within a circumferential gap 42 formed in the outer circumference of rotary means or trip disk 12 in a manner that imparts a downward counter-force to the disk which imparts a horizontal motion to feeler 10. Circumferential gap 42 is slightly larger than the combined diameters of balls 32, 34, and 36 leaving a clearance space 44 which allows the balls to travel freely in slot 38. A rapid reaction of feeler 10 effects a vertical movement of the balls independently of each other so that on a return downward vertical movement, the balls work against each other so that each absorbs the energy of the other. This effects a hammering motion between the balls and provides means to dampen any rapid pendular oscillations or "bouncing" motions to be imparted to feeler 10. While steel is preferred, the balls may also be made from different materials. For example, one ball may be rubber, plastic, or other soft material which will effect a slightly different force and motion to the feeler. The materials and dampening effects on the bouncing motion of feeler 10 may be varied depending upon the application being made and the web being sensed. The balls may also be different sizes.

Balls 32, 34, and 36 lightly engage outer concave wall 38*c* of slot 38 during pendular movement of feeler 10. This provides a slight resistance during travel through the arc effected by slot 38 so that the pressure against feeler 10 is not constant and changes within arc 30. This further reduces the tendency of the feeler to bounce in rapid pendular oscillations when striking a web edge. This bouncing motion is detrimental to the uniform motion as it imparts a chain reaction as signals are transmitted at a higher frequency than movement. The sensor may continuously bounce and hunt for the web edge, unable to find its rest position.

Figure 3:
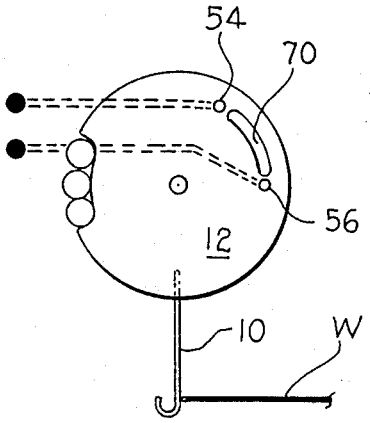
FIG. 3 is an elevation illustrating the feeler and switch disk in a neutral position.
Figure 4:
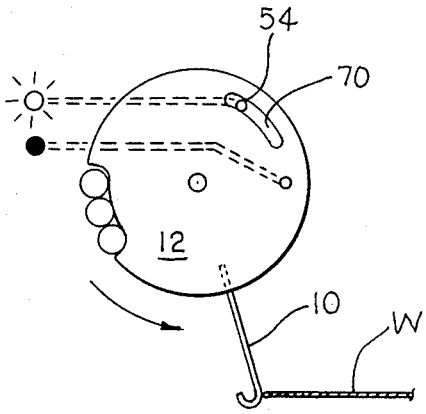
FIG. 4 is an elevation of a feeler and switch disk in a web right position.
Figure 5:
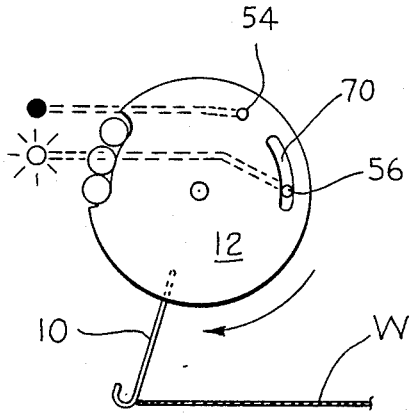
FIG. 5 is an elevation of a feeler and switch disk in a web left position.
Figure 6:
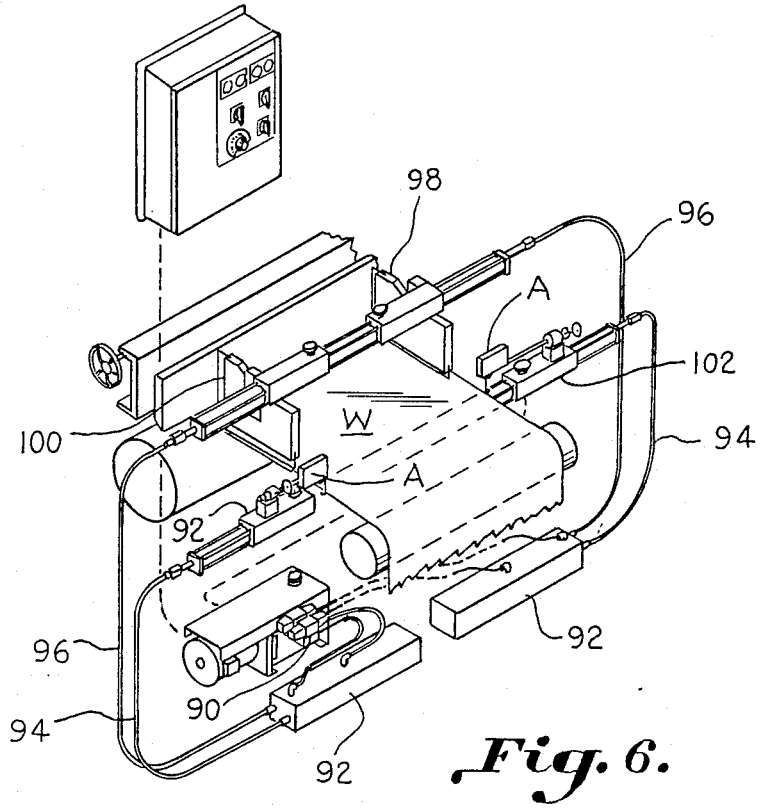
FIG. 6 is a perspective view illustrating application of a web edge sensor constructed in accordance with the present invention for guiding a web on a coding machine.

Detector means actuated by movement of the web W and feeler 10 includes beam means having two directional energy beams for detecting two positions of web W. The beams may be interrupted by a contactless breaker so mechanical switching is not needed. Preferably, the beams are directional light beams 50*a*, 52*a* produced by light emitting diodes (LEDs) 50 and 52 feed light through fiber optic cables 54 and 56. This light is received by fiber optic cables 58 and 60 carried by housing section 24. Fiber optic cables 58 and 60 deliver light to light sensors 62 and 64. An additional fiber optic cable 66 picks up a portion of the light coming from fiber optic cables 54, 56 and focuses the light on the sensor faces of 62 and 64 to provide a visual indication of the operating condition. A conventional amplifier 72 receives the signals from receiver sensors 62, 64 and amplifies these signals. The amplified signals activate a conventional switching relay circuit 74 which is delivered to the control system which controls the drive of movable tenter rails or other web guiding devices to which application of the invention is being made. A contactless breaker is provided by a slotted window 70 formed in trip disk 12 through which light from fiber optic cables 54, 56 may be transmitted to cables 60, 58, respectively. FIGS. 3, 4, and 5 illustrate three modes of operation used to sense and guide traveling web W. In FIG. 3, feeler 10 is illustrated in a stationary at rest position in which web W is in a desired position. The edge of web W holds feeler 10 in a vertical position. Due to the geometrical configuration of window 70, light is prevented from passing from either cable 54 or 56. Two dark signals are received by sensor 62 and 64. There is no current in electrical amplifier circuit 72 and relay circuit 74 is not activated. FIG. 4 illustrates feeler 10 in a far right position against the web edge as moved there by the weight of balls 32, 34, and 36. In this position, light from fiber optic cable 54 is transmitted through fiber optic cable 60. This positive signal from sensor 62 is delivered to amplifier circuit 72 which drives the relay circuits 74. Relay circuit 74 activates the control system guiding the web and the web is moved until feeler 10 again comes to the rest position of FIG. 3. FIG. 5 illustrates movement of web W to a leftmost position which causes light from fiber optic cable 56 to be transmitted through window 70 while received by fiber optic cable 58 and transmitted to light sensor 64. The signal from sensor 64 is translated electrically to a positive signal, amplified by amplifier circuit 72 to activate relay circuit 74 and control the control system to guide web W back until feeler 10 comes to the rest position of FIG. 3.

While directional beams 50*a*, 52*a* are illustrated as light beams, other forms of directional energy beams may also be used. Virtually any directional energy beam wherein energy particles are concentrated generally in a beam form which can be interrupted and sensed may be used. For example, air jets may be used instead of light. The fiber cables may be replaced with small air tubes interrupted by disk 12 and transmitted through window 70 and be detected by suitable sensors for producing signals as before described.

Applications of web edge sensor A will now be described. As can best be seen in FIG. 7, sensor A is illustrated controlling a web W on a tenter frame rail to position the travelling web travelling in the direction as shown by the arrow. Web sensor A is directly mounted to the spaced apart tenter rails 80. A web position signal from sensor A and relay circuit 74 is transmitted to relay controlled solenoid valve 82 which admits fluid to move the piston of a double acting hydraulic cylinder 84. Cylinder 84 is operatively connected to each rail 80 for moving the rail to adjust the lateral position of web W as it travels. Movement of the tenter rail moves the web to engage feeler 10 of sensor A to establish it in the neutral position shown in FIG. 3. This corresponds to a desired web and rail position with relation to the travelling web.

Figure 7:
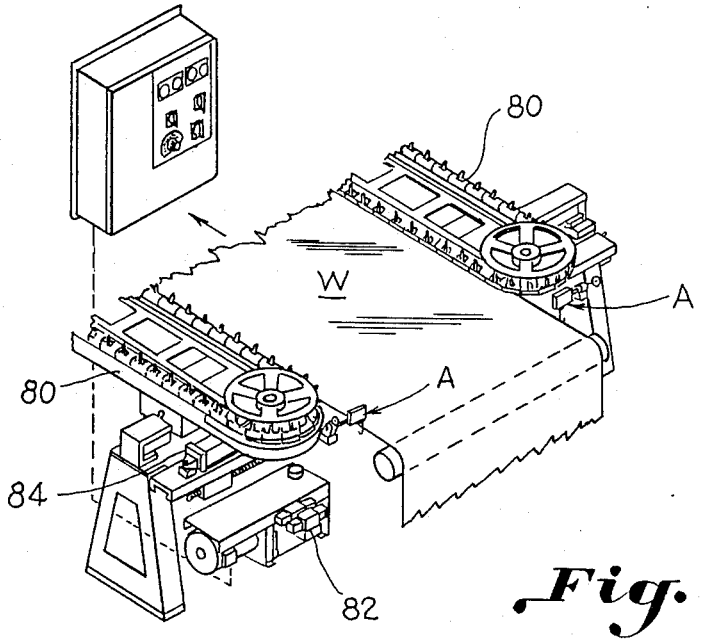
FIG. 7 is a perspective view illustrating the application of a web edge sensor constructed in accordance with the present invention for guiding a web on a tenter frame.

As can best be seen in FIG. 7, web sensor A is illustrated in an application with a typical textile coater.

Sensor A detects the movement of web W and sends a left or right web position signal to solenoid valves 90 which actuate fluid cylinders 92. The fluid cylinders 92 are operatively connected to push/pull flexible cables 94 and simultaneously to flexible cables 96. The cylinders actuate flexible steel cables 96 to move a pair of dams 98 and 100 to contain the width of a coating material being applied to the web. In this manner, the web edge is sensed and the dams are adjusted correspondingly so that the coating material is located over the width of the web. As the edge of the web deviates, the dams are moved so as to contain the material over the width of the web. Simultaneously, fluid cylinders 92, move cables 94 connected to movable sensor mounts 102 to move the sensors with the dam to the neutral position of FIG. 3.

Figure 8:
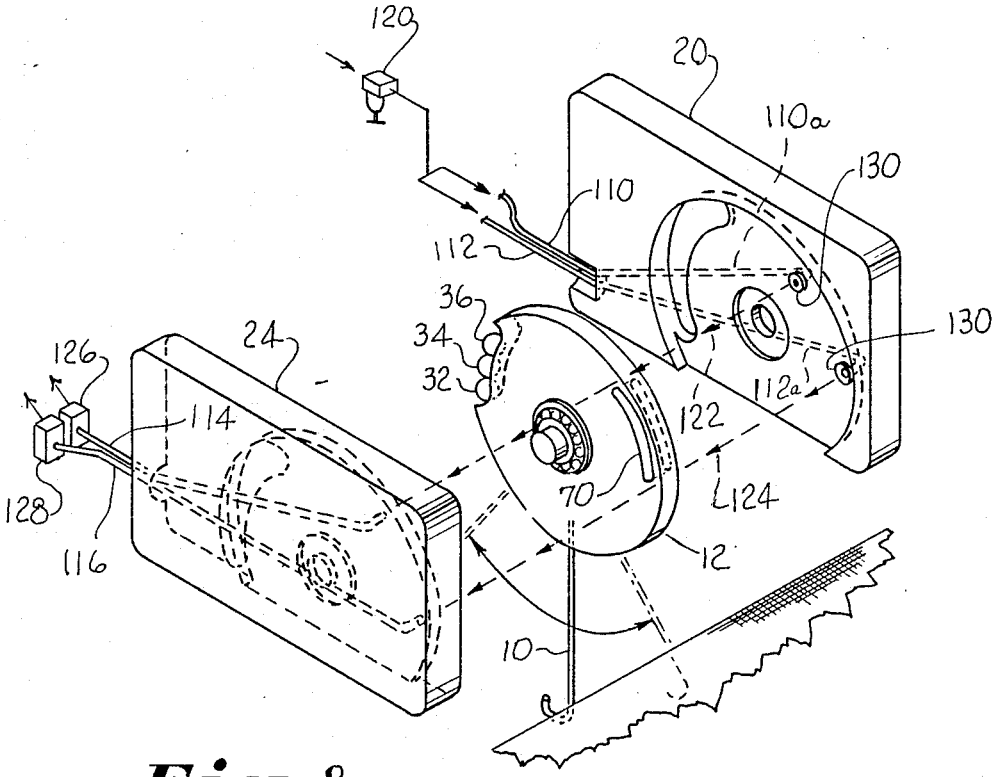
FIG. 8 is the air jet equivalent of the FIG. 1 embodiment.
Figure 9:
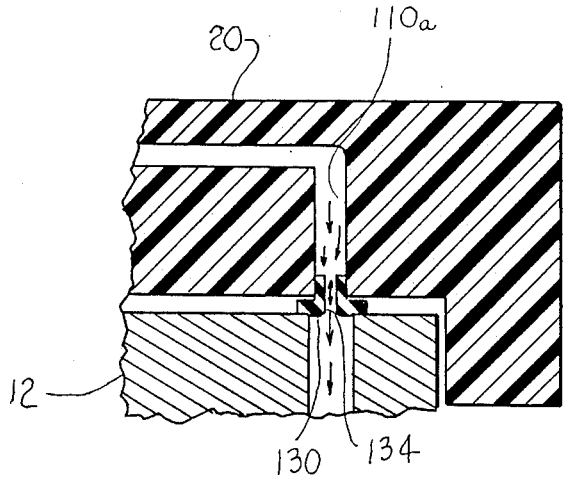
FIG. 9 illusttates an air outlet used in the FIG. 8 embodiment.

An additional embodiment of the invention is illustrated in FIG. 8 wherein the energy beam which is interrupted by rotary trip disk 12 is an air jet instead of a light beam. As can best be seen in FIG. 8, the construction of this embodiment is essentially identical to that of FIG. 1 except that the fiber optic cables 54, 56, 58, and 60 are replaced with small air tubes 110, 112, 114, and 116, respectively. Instead of the light source LEDs 50 and 52, a source of low pressure air is supplied from a commercially available air pressure regulator 120 to the small diameter tubes 110 and 112 to produce two independent air jets 122 and 124. Tubes 110 and 112 are arranged directly across from receiving tubes 114 and 116, respectively. Switching relays 126 and 128 are exposed for receiving air jets 122 and 124, respectively, to be actuated by them. The switching relay signals may then be transmitted to amplifier circuit 72 and relay circuit 74 as in the case of FIG. 1 for controlling the position of the web or related web sensitive elements. If both air jets 122 and 124 are blocked, feeler 10 is in the neutral position and no signal is transmitted as illustrated in FIG. 3 for the light beams. If air jet 122 is transmitted by window 70, a web right signal is generated as illustrated in FIG. 4 so that the web is moved back to the left bringing feeler 10 to the neutral position. If air jet 124 is transmitted, as can best be seen in FIG. 5, a web left signal is transmitted to move the web back to the right bringing feeler 10 to its neutral position. FIG. 9 illustrates an air seal means in the form of a bushing 130 which is in an air outlet opening 110*a*, 112*a*, of air tubes 110 and 112. This slides in the air tubes opening. The central aperture 134 of bushing 130 has a diameter reduced to the diameter of air tube opening 132. This causes air pressure to force bushing 134 outward against rotary disk 12. This provides an effective seal when the air jet is being transmitted that prevents air escapage.

While a preferred embodiment of the invention has been described using specific terms, such description is for illustrative purposes only, and it is to be understood that changes and variations may be made without departing from the spirit or scope of the following claims.

What is claimed is:

1. A web edge sensor having a feather light sensing action for sensing the edge of a travelling web without distorting the edge comprising:

a housing for mounting adjacent said web;

a trip disk rotatably carried by said housing;

a feeler carried by said trip disk for engaging said web edge and moving in a pendular motion in response to web movement;

a plurality of weighted balls carried by said trip disk;

coupling means for carrying said balls on said trip disk in said housing so that said weighted balls dampen rapid oscillations in the pendular motion of said feeler in response to the interactive engagement between said feeler and said web edge during high speed travel of said web; and detector means actuated in response to the rotation of said trip disk as effected by said pendular motion of said feeler for generating a web position signal indicative of the position of the edge of said web for controlling and guiding said travelling web.

2. The apparatus of claim 1, wherein said coupling means includes a gap formed in said trip disk in which said balls are placed, said gap having a free space defined in said gap when said balls are in place so that said balls may move in opposing directions to hammer against one another to dampen said rapid oscillations.

3. The apparatus of claim 1, wherein said detector means includes beam means disposed on one side of said disk for transmitting a directional energy beam along a path, breaker means carried by said trip disk for interrupting transmission of said energy beam along said path, and switch means detecting said beam interruptor.

4. The apparatus of claim 2, wherein said gap is formed by a cut out in an outermost circumferential portion of said disk.

5. The apparatus of claim 2 including limit means for limiting the pendular motion of said feeler to a prescribed arc.

6. The apparatus of claim 5, wherein said limit means includes at least one arcuate slot formed in said housing in which said balls are partly received to couple said disk to said housing, said arcuate slot having first and second opposing ends between which said balls move and which limit the extent of movement of said feeler to said prescribed arc.

7. The apparatus of claim 3 including an amplifier for amplifying said position signal.

8. The apparatus of claim 3, wherein said beam means includes a light source means for emitting and transmitting a directional light beam, and said switch means includes a photocell for detecting the interruption of said light beam by said breaker means.

9. The apparatus of claim 3, wherein said breaker means includes a slotted window formed in said disk through which said energy beam is transmitted.

10. The apparatus of claim 3, wherein said beam means includes a first light beam and a second light beam, a first fiber optic cable for transmitting said first light beam through said housing near said trip disk on said one side of said disk, a second fiber optic cable for transmitting said second light beam through said housing to near said trip disk on said one side of said disk, receiver means including a third fiber optic cable arranged on said opposing side of said disk for receiving said first light beam and delivering said first light beam to a first photocell, a fourth fiber optic cable arranged on said opposing side of said disk for receiving said second light beam and delivering said second light beam to a second photocell, and said first and second photocells included in said switch means.

11. The apparatus of claim 3, wherein said beam means includes a source of air pressure for emitting and transmitting a directional air jet along said path, said air jet being interrupted by said breaker means and said interruption being detected by said switch means.

12. The apparatus of claim 9, wherein said beam means includes a first directional energy beam and a second directional energy beam spaced apart circumferentially with respect to said disk, said first and second energy beams transmitting past said breaker means when said feeler means is in a neutral position, said first energy beam being blocked by said breaker means when said feeler means is in a web left position in which said web has deviated in its path of travel laterally to the left, said second light being blocked by said breaker when said feeler means is in a web right position in response to said travelling web moving laterally to the right.

13. The apparatus of claim 10, wherein said breaker means includes an arcuate slotted window formed in said trip disk having first and second remote ends, said first light beam being blocked when said first end of said window rotates past said first light beam to produce a first web position signal, said second light beam being blocked by said disk when said second end of said window rotates past said second light beam to produce a second web position signal, and said window transmitting both said first and second light beams to produce a third web position signal.

14. The apparatus of claim 11 including an air tube opening from which said air jet is emitted, a slidable air bushing carried in said air tube opening in a slidable manner; and said air bushing being forced against said rotary disk in response to said air jet for providing an air seal.

15. A web edge sensor having a feather light sensing action for sensing the edge of a travelling web without distorting the edge comprising:

a feeler for engaging a web edge of said travelling web;

rotary means for rotatably carrying said feeler near said web in engagement with said web edge, said rotary means carrying said feeler in a pendular motion in response to engagement with said web;

limit means for limiting the pendular motion of said feeler to within a prescribed arc;

dampening means carried by said rotary means for reducing rapid oscillations in the pendular motion of said feeler in response to engagement with said web edge;

detector means for sensing the pendular motion of said feeler in response to lateral movement of said web edge to generate a position signal representing the position of said web edge for controlling and guiding said travelling web.

16. The apparatus of claim 15, wherein said detector means includes a first directional energy beam and a second directional energy beam transmitted across a path of said rotary means, contactless breaker means carried by said rotary means for interrupting said directional energy beams in response to the lateral movement of said web and resulting pendular movement of said feeler.

17. The apparatus of claim 15, wherein dampening means includes a plurality of weighted balls carried by said rotary means, coupling means coupling said balls to said rotary means arranged and constructed so that said balls may move against each other in a hammering motion to dampen erratic and rapid movements of said feeler.

18. A web edge sensor comprising:

a housing;

rotary means carried by said housing for rotational motion;

a feeler carried by said rotary means in a depending manner for movement in a pendular motion, said feeler engaging a web edge for being moved by said web in response to lateral movements of said travelling web;

coupling means coupling said rotary means to said housing for limiting the pendular motion of said feeler to a prescribed arc and for dampening rapid oscillations in the pendular motion of said feeler in response to engagement with said web travelling at high speeds; and detector means actuated in response to rotation of said rotary means as said feeler is engaged and moved laterally by said web edge for generating a position signal representative of the lateral movement of said web.

19. The apparatus of claim 18, wherein said detector means includes:

a first directional energy beam for being transmitted across a path of said rotary means and a second directional energy beam for being transmitted across a path of said rotary means;

contactless breaker means carried by said rotary means for interrupting the transmission of said first and second directional energy beams; and receiver means for receiving said directional energy beams and detecting interruption of said directional energy beams to generate a web position signal indicating the lateral movement of said travelling web.

20. The apparatus of claim 18, wherein said coupling means includes:

a plurality of weighted balls carried by said rotary means constructed and arranged so that said plurality of balls may move in opposing directions to hammer against each other and dampen any erratic and rapid oscillations in said pendular motion of said feeler in response to high speed travelling engagement of said feeler by said web.

* * * * *